US007667605B2

(12) United States Patent
Conway et al.

(10) Patent No.: US 7,667,605 B2
(45) Date of Patent: Feb. 23, 2010

(54) RFID DETECTION OF AIR VENT CONDITION IN INKJET PRINTER SUPPLIES

(75) Inventors: John Yeung Conway, Louisville, KY (US); Bhaskar Ramakrishnan, Wilsonville, OR (US)

(73) Assignee: Lexmark International, Inc., Lexington, KY (US)

( * ) Notice: Subject to any disclaimer, the term of this patent is extended or adjusted under 35 U.S.C. 154(b) by 367 days.

(21) Appl. No.: 11/692,390

(22) Filed: Mar. 28, 2007

(65) Prior Publication Data

US 2008/0238704 A1 Oct. 2, 2008

(51) Int. Cl.
*G08B 13/14* (2006.01)

(52) U.S. Cl. ..... 340/572.8; 340/572.1; 340/10.1

(58) Field of Classification Search ..... 340/572.8, 340/572, 10, 505; 347/86, 19
See application file for complete search history.

(56) References Cited

U.S. PATENT DOCUMENTS 6,938,984 B2 * 9/2005 German et al. ..... 347/43
7,212,637 B2 * 5/2007 Salisbury ..... 380/270
2004/0135859 A1 * 7/2004 German et al. ..... 347/95
2005/0024412 A1 * 2/2005 Hudd et al. ..... 347/19
2008/0186187 A1 * 8/2008 Adkins et al. ..... 340/572.8
2008/0186367 A1 * 8/2008 Adkins et al. ..... 347/86
2008/0232883 A1 * 9/2008 Klein et al. ..... 400/76

* cited by examiner

*Primary Examiner*—Travis R Hunnings

(57) ABSTRACT

Embodiments of an ink tank are provided, which comprise an ink tank housing, at least one air vent disposed on the housing, and at least one RFID tag disposed on the housing, wherein the at lest one RFID tag is operable to communicate with an RFID reader. The ink tank further comprises a sealing component operable to close the air vent. The sealing component has conductivity operable to interfere with the communication of the RFID tag and the RFID reader such that the RFID tag is incapable of communicating with the RFID reader when the vent is closed.

14 Claims, 2 Drawing Sheets

RFID DETECTION OF AIR VENT CONDITION IN INKJET PRINTER SUPPLIES

TECHNICAL FIELD

The present invention generally relates to ink tanks used in printing systems. More particularly, the present invention relates to ink comprising RFID components operable to identify whether an air vent of an ink tank is open or closed.

BACKGROUND

Imaging devices, such as printers, often employ a print head for printing on a printable medium, such as paper. Ink is usually supplied to the print head from an ink reservoir or ink tank via a flow passage. The ink tank and print head may form a single print cartridge unit or may comprise separate components. During printing, ink flows from the ink tank to the print head through some conduit.

Ink tanks are vented to atmospheric pressure to prevent excessive vacuum pressures within the reservoir that can reduce or prevent ink flow to the print head. In addition, venting relieves pressure buildups that can occur when an ink tank is exposed to extreme environmental conditions, e.g., that can be encountered during shipping, such as high temperature in motor vehicles or low pressures in airplanes at high altitudes.

During packaging and shipping, an ink tank is shipped to the customer in a package that seals the air vent using some type of sealing component. This ensures that the pressure differentials during altitude change, etc do not affect the internal components or operability of the ink tank. Once the ink tank is removed from a package, the user is instructed to remove the sealing component from the vent. If an ink tank with its air vent sealed is installed into a printer and the printer starts to print, the backpressure within the print head increases. As a result, the heater and nozzles in the print head chip may be overwhelmed and the print head may become de-primed. Once de-primed, the print head may catastrophically fail, and thereby may require replacement.

As a result, there is a need for ink tanks having components designed to prevent a print head from using a sealed ink tank and thereby prevent catastrophic failure.

SUMMARY

In accordance with one embodiment of the present invention, an ink tank embodiment is provided. The ink tank comprises an ink tank housing, at least one air vent disposed on the housing, and at least one RFID tag disposed on the housing, wherein the is operable to communicate with an RFID reader. The ink tank further comprises a sealing component operable to close the air vent. The sealing component has a conductivity operable to interfere with the communication of the RFID tag and the RFID reader such that the RFID tag is incapable of communicating with the RFID reader when the vent is closed.

In accordance with another embodiment of the present invention, a method of producing a sealed ink tank, which is inoperable when sealed, is provided. The method comprises the steps of: providing an ink tank comprising an air vent and at least one RFID tag, wherein the RFID tag has a signal frequency tuned to the signal frequency of an RFID reader; and, applying a sealing component over the air vent and proximate the RFID tag. The sealing component comprises a conductive material having conductivity effective to detune the frequency of the RFID reader, wherein the detuning of the RFID reader prevents the use of the ink tank.

In accordance with yet another embodiment of the present invention, a method for detecting the presence of a sealing component of an air vent of an ink tank comprising the steps of: providing an ink tank comprising an air vent and at least one RFID tag, as well as an RFID reader in communicable range of the RFID tag; delivering a signal from the RFID tag; and, detecting the presence of a sealing component on the air vent when a signal delivered by the RFID tag is received by the RFID reader.

Additional features and advantages provided by the embodiments of the present invention will be more fully understood in view of the following detailed description, in conjunction with the drawings.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
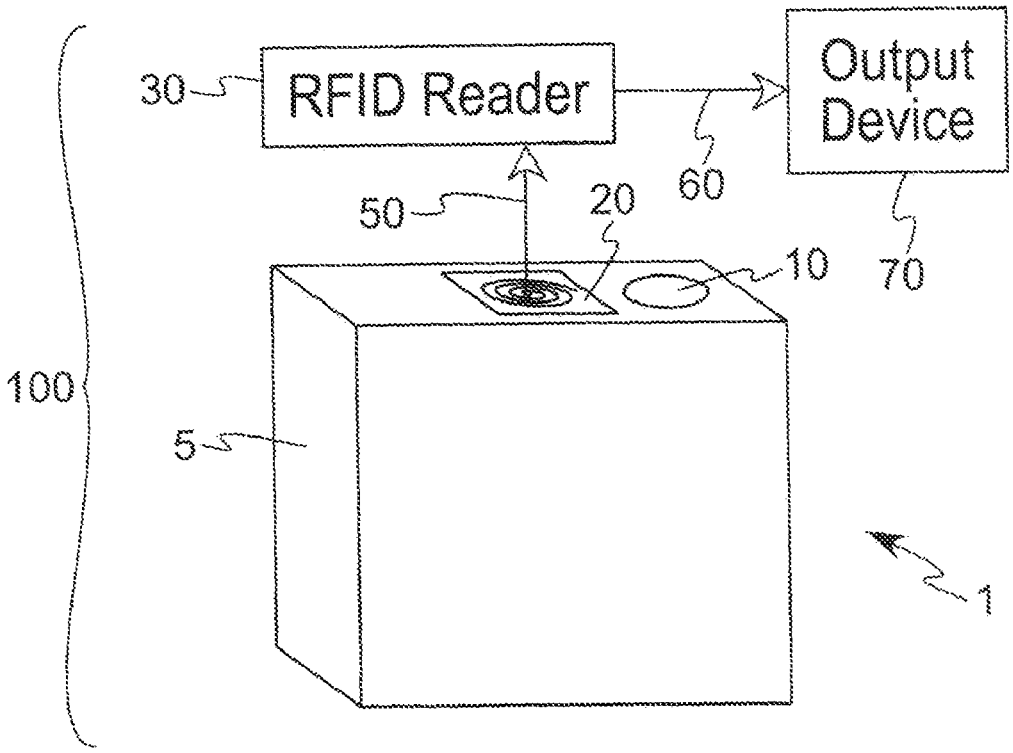
FIG. 1 is a schematic representation of an ink tank with an RFID tag having no sealing component thereon according to one or more embodiment of the present invention.

The embodiments set for the in the drawings are illustrative in nature and not intended to be limiting of the invention defined by the claims. Moreover, individual features of the drawings and the invention will be more fully apparent and understood in view of the detailed description.

DETAILED DESCRIPTION

Reference will now be made in detail to various embodiments of the invention, examples of which are illustrated in the accompanying drawings, wherein like numeral indicate similar elements throughout the views.

Referring to FIG. 1, an ink tank 1 for a printer 100, for example, an inkjet printer is provided. The ink tank 1 comprises an ink tank housing 5 configured to store ink for delivery to the print head (not shown) of a printer 100. The ink tank 1 may be its own component or may, in combination with a print head, form a print cartridge unit (not shown). The ink tank housing 5 comprises at least one air vent 10 disposed on the housing. In the exemplary embodiment of FIG. 1, the air vent 10 is disposed on the upper portion of the ink tank housing; however, other locations on the ink tank housing are contemplated herein. The ink tank housing 5 also comprises at least one RFID tag 20 disposed on the housing 10. The RFID tag may comprise various components known to one of ordinary skill in the art. The RFID tag 20 may comprise a metal conductor, for example, a coiled copper wire. RFID tags may include 13.56 MHz RFID tags produced by Philips Semiconductor, TI-RFid™ tags produced by Texas Instruments, or 900 MHz RFID tags produced by Avery-Dennison. The RFID tag 20 is operable to communicate with an RFID reader 30 when the air vent 10 is open, as in FIG. 1. In one embodiment, the RFID reader 30 is arranged within communicable range, i.e., a distance wherein the RFID reader 30 is capable of receiving a signal from the RFID tag 20. The RFID reader 30 may comprises various components known to one of or ordinary skill in the art. For example, the RFID reader may comprise one or more metal antennas, transceivers, circuit boards, or combinations thereof. Multiple configuration of the RFID reader components are contemplated herein. RFID readers may be obtained from Texas Instruments, or ThingMagic LLC.

For proper communication, the RFID reader 30 and the RFID tag 20 are tuned to the same frequency. The RFID tag 20 and RFID reader 30 may be programmed according to various techniques known to one of ordinary skill in the art. In some embodiments, the RFID reader 30 receives a signal from the RFID tag 20 and, as described below, informs the printer and/or print head that the ink tank 1 is properly installed and ready for printing. Alternatively, the RFID reader 30 may be connected via a circuit to an output device 70, which, in turn, informs the user and/or the printer that the ink tank 1 is properly installed and ready for printing. The output device 70 may include, for example, and not by way of limitation, a lighting element, such as a lamp or a light emitting diode, a light pipe, a digital display, or combinations thereof.

RFID tags 20 are capable of storing various additional pieces of data regarding the ink tank. For example, and not by way of limitation, the RFID tag 20 may store and provide to the RFID reader 30: the ink tank model, the ink tank model number, the serial number, the shipping date, the shipping location, the ink volume, the ink color, as well as other data known to one of ordinary skill in the art.

Figure 2:
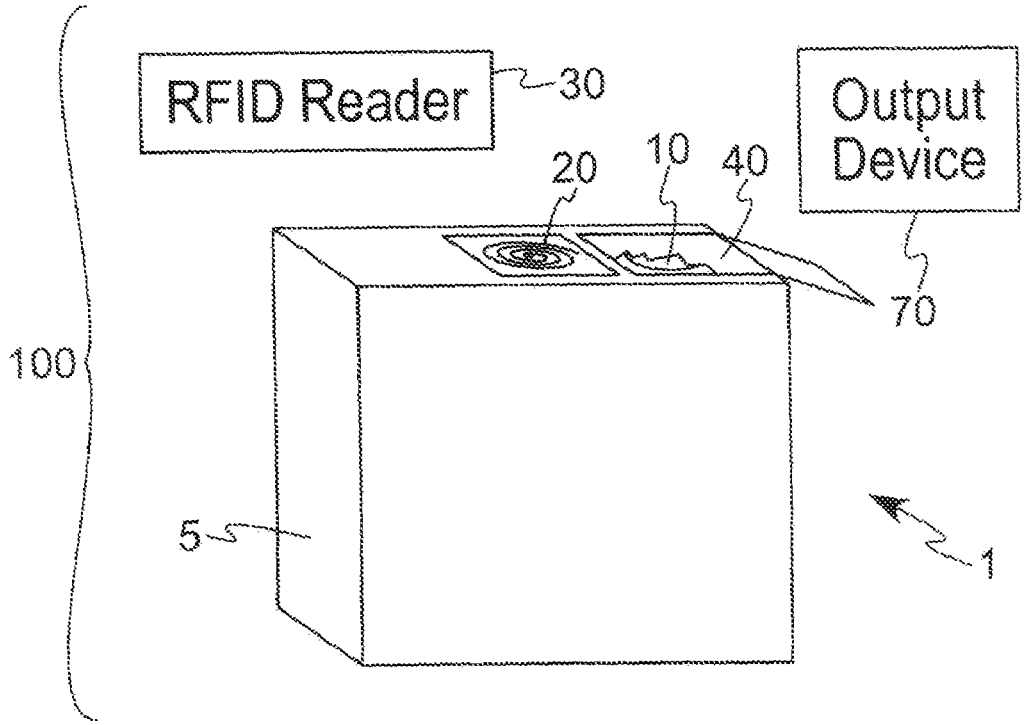
FIG. 2 is a schematic representation of an ink tank with an RFID tag having a sealing component disposed over an air vent but not over the RFID tag of the ink tank according to one or more embodiments of the present invention.
Figure 3:
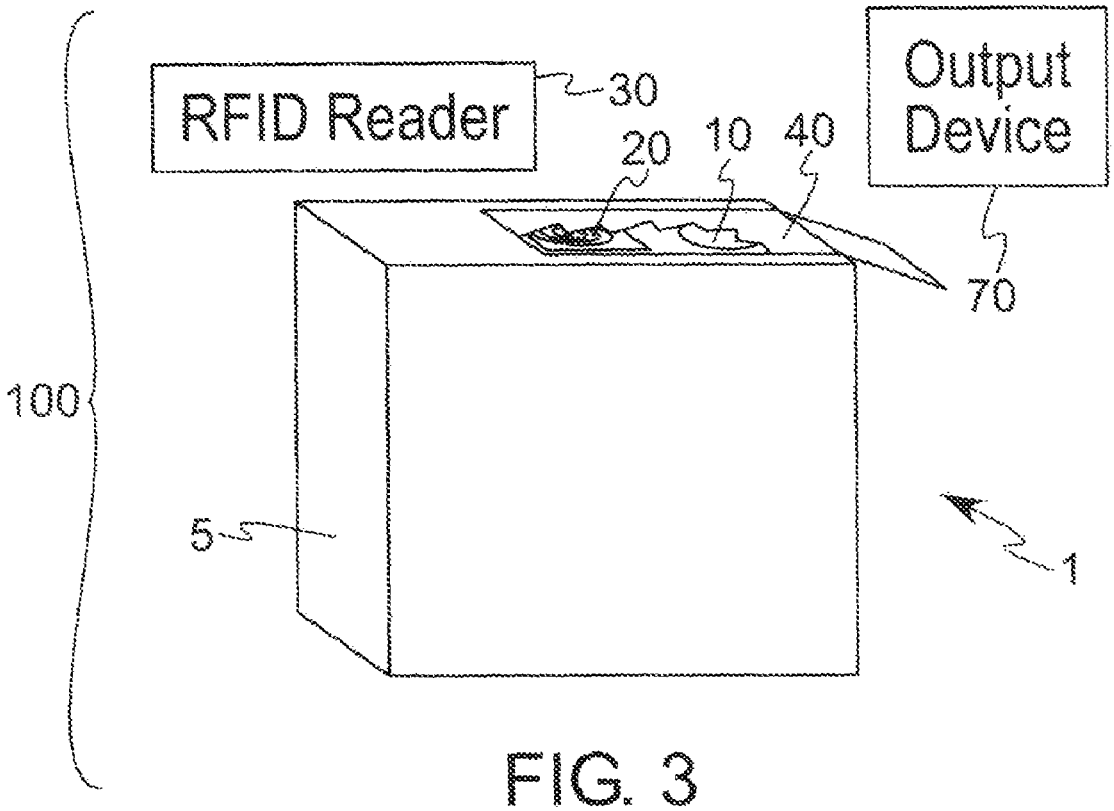
FIG. 3 is a schematic representation of an ink tank with an RFID tag having a sealing component disposed over an air vent and the RFID tag of the ink tank according to one or more embodiments of the present invention.

Referring to FIGS. 2 and 3, the ink tank 1 may include a sealing component 40. In FIG. 2, the sealing component is covers the air vent 1 but not the RFID tag 20. In FIG. 3, the sealing component 40 covers both the air vent 10 and RFID tag 20. In embodiments in which the RFID tag 20 is capable of receiving and storing data, having the sealing component 40 cover the RFID tag 20 can prevent the RFID tags 20 from being erased or overwritten either inadvertently or by malicious parties. In some instances, programming and/or customization of the RFID tags 20 at the end of the manufacturing process or as part of a distribution change may make it advantageous to leave the RFID tag 20 uncovered.

The sealing component 40 may comprise any suitable components having an electrical conductivity operable to detune the frequency of the RFID reader 30. The closer the RFID reader 30 is to the sealing component 40, the greater the interference caused by the sealing component 40. In some embodiments, placing the sealing component directly over the RFID tag 20 maximizes this interference. For example, and not by way of limitation, the sealing component 40 may comprise an adhesive material, e.g., a tape strip comprising a metal conductor coupled therewith. In one exemplary embodiment, the sealing component 40 may comprises a tape strip comprising copper foil, wherein the copper foil has conductivity that detunes the frequency of the RFID reader 30. Other sealing embodiments known to one of ordinary skill in the art are contemplated herein.

When the RFID reader 30 and RFID tag 20 are detuned, the RFID reader 30 does not receive the signal from the RFID tag 20, and absent this signal, the printer is configured to assume that no ink tank 1 is present or that the ink tank is not properly installed. In either case, the printer does not print, which, in the case of an improperly installed tank, could lead to a de-primed print head. In embodiments in which an output device 70 is present, the absence of a signal received by the RFID reader 30 from the RFID tag 20 results in an indication from the output device 70 that an ink tank 1 is not properly installed. In some embodiment, the output device 70 may provide an indication to a user that the printer is not ready to print, while in other embodiments, the output device 70 may provide another means of communicating this information to the printer or a print head, as appropriate.

It is noted that terms like "specifically," "generally" "optionally", "preferably," "typically", "often", and the like are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An ink tank comprising:

an ink tank housing;

at least on air vent dispose on the housing;

at least one RFID tag disposed on the housing and operable to communicate with an RFID reader;

a sealing component operable to close the at least one air vent, the sealing component disposed in such a way that when the vent is closed the sealing component inhibits communication between the RFID tag and the RFID reader.

2. An ink tank according to claim 1 wherein the sealing component covers the at least one air vent and at least partially covers the RFID tag.

3. An ink tank according to claim 1 wherein the sealing component comprises at least one metal component.

4. An ink tank according to claim 3 wherein the at least one metal component is copper.

5. An ink tank according to claim 1 wherein the sealing component is an adhesive strip having a copper foil.

6. An ink tank according to claim 1, further comprising an output device responsive to the RFID reader, the output device being triggered by a successful communication between the RFID reader with the RFID tag.

7. An ink tank according to claim 6 wherein the output device is a lighting element.

8. An ink tank according to claim 1 wherein a frequency of a signal from the RFID tag is altered by he sealing component when the vent is covered by the sealing component.

9. A method of determining whether an ink tank is present, wherein the ink tank includes an RFID tag configured to be read by an RFID reader of a printing device, the method comprising:

aligning the RFID reader at a predetermined position;

transmitting a radio frequency signal from the RFID reader, the radio frequency signal configured such that when the radio frequency signal is received at an antenna of the RFID tag, the RFID tag transmits a response radio frequency signal to the RFID reader;

indicating to the printer that the ink t is properly installed when the response radio frequency signal is received by the RFID reader; and indicating to the printer that the ink tank is not properly installed in the absence of a response radio frequency signal wherein the absence of a response radio frequency signal is due to a sealing component that covers at least vent on a lid of the ink tank that inhibits the communication between the RFID reader and the RFID tag.

10. The method of claim 9, wherein the step of aligning the RFID reader comprises aligning one or more ink tanks with a stationary RFID reader.

11. The method of claim 9 wherein the step of aligning the RFID reader comprises moving sequentially each of a plurality of ink tanks into alignment with an RFID reader.

12. The method of claim 9, wherein the predetermined position is a position at which the RFID reader is able to send a radio frequency signal to the RFID tag and receive a response radio frequency signal from the RFID tag when the ink tank is properly installed.

13. The method of claim 9, further comprising the step of providing a visual indication that indicates to user that the ink tank is properly installed.

14. A method of producing a sealed ink tank, which is inoperable when sealed comprising:

providing an ink tank comprising air vent and at least one RFID tag wherein the RFID tag has signal frequency tuned to the signal frequency of an RFID reader; and applying a sealing component over the air vent and proximate the RFID tag, the sealing component comprising a conductive material having conductivity effective to detune the frequency of the RFID reader wherein the detuning of the RFID reader prevents the use of the ink tank.

* * * * *